US010480218B2

(12) United States Patent
Barron

(10) Patent No.: US 10,480,218 B2
(45) Date of Patent: Nov. 19, 2019

(54) SECURITY DEVICES AND STRAPS THEREFOR

(71) Applicant: ZEAL INNOVATION LTD, Swansea (GB)

(72) Inventor: Neil Anthony Barron, Swansea (GB)

(73) Assignee: ZEAL INNOVATION LTD. (GB)

( * ) Notice: Subject to any disclaimer, the term of this patent is extended or adjusted under 35 U.S.C. 154(b) by 305 days.

(21) Appl. No.: 15/102,338

(22) PCT Filed: Dec. 9, 2014

(86) PCT No.: PCT/GB2014/053646
§ 371 (c)(1),
(2) Date: Jun. 7, 2016

(87) PCT Pub. No.: WO2015/087067
PCT Pub. Date: Jun. 18, 2015

(65) Prior Publication Data

US 2016/0348402 A1 Dec. 1, 2016

(30) Foreign Application Priority Data

Dec. 9, 2013 (GB) ..... 1321722.9
Dec. 9, 2013 (GB) ..... 1321723.7
Sep. 23, 2014 (GB) ..... 1416799.3

(51) Int. Cl.
*E05B 67/00* (2006.01)
*E05B 71/00* (2006.01)
*E05B 73/00* (2006.01)

(52) U.S. Cl.
CPC ..... *E05B 73/0005* (2013.01); *E05B 67/003* (2013.01); *E05B 71/00* (2013.01)

(58) Field of Classification Search
CPC ..... E05B 67/003; E05B 67/006; E05B 69/00; E05B 71/00; E05B 73/0005; E05B 73/0011; E05B 73/0029; E05B 73/007
See application file for complete search history.

(56) References Cited

U.S. PATENT DOCUMENTS 2,820,269 A 1/1958 Wolff
2,865,978 A 12/1958 Modrey
(Continued)

FOREIGN PATENT DOCUMENTS

CH 620493 A5 12/2011
DE 9015213 U1 1/1991
(Continued)

OTHER PUBLICATIONS

U.K. Search Report for Application No. GB1321722.9 dated Jun. 10, 2014, 3 pages.
(Continued)

*Primary Examiner* — Christopher J Boswell
(74) *Attorney, Agent, or Firm* — McAndrews, Held & Malloy, Ltd.

(57) ABSTRACT

A strap for a security device has a core (12,62) within a flexible sleeve (14,64), and the sleeve is extensible independently of the core such that the core is not under tension. Because the core is not under tension, it is more difficult to cut and substantially inhibits, if not prevents, cutting of the sleeve. The core may take various forms which resist cutting in different ways. Examples are elongate, normally metallic planar bodies (12,34,38) having longitudinal flexibility but resistance to lateral flexure, and extensible springs (16,22, 26). The sleeve (14,64) can also be designed to complicate any attempt to cut the strap as a whole, and may comprise multiple layers (76,78).

34 Claims, 4 Drawing Sheets

(56) References Cited

U.S. PATENT DOCUMENTS

| | | | | |
|---|---|---|---|---|
| 4,157,602 | A * | 6/1979 | Pennell | E05B 73/0005 24/122.3 |
| 4,177,541 | A * | 12/1979 | Seakan | E05B 73/0005 24/122.3 |
| 4,694,541 | A | 9/1987 | Skyba | |
| 4,860,408 | A | 8/1989 | Johnson | |
| 7,096,696 | B2 * | 8/2006 | Devecki | B63C 11/02 70/18 |
| 8,556,555 | B2 * | 10/2013 | Lesley | B60P 7/0838 410/100 |
| 9,322,131 | B2 * | 4/2016 | Chuang | D07B 1/10 |
| 9,334,678 | B2 * | 5/2016 | Allen | E05B 67/003 |
| 9,470,021 | B2 * | 10/2016 | Kindstrand | E05B 73/0005 |
| 9,663,975 | B2 * | 5/2017 | Castro | E05B 67/24 |
| 2008/0276664 | A1 * | 11/2008 | Shu | B62H 5/003 70/18 |
| 2011/0219826 | A1 | 9/2011 | Jeli et al. | |
| 2012/0042700 | A1 * | 2/2012 | Barron | E05B 17/106 70/15 |
| 2015/0082841 | A1 * | 3/2015 | Lebeaume | E05B 67/003 70/15 |

FOREIGN PATENT DOCUMENTS

| | | |
|---|---|---|
| GB | 2476796 | 7/2011 |
| GB | 2476796 A | 7/2011 |
| JP | 3172632 U | 1/2012 |
| WO | 20100116350 | 10/2010 |

OTHER PUBLICATIONS

International Search Report and Written Opinion corresponding to International Patent Application No. PCT/GB2014/053646, dated Jun. 23, 2016, 7 pages.

International Search Report and Written Opinion corresponding to International Patent Application No. PCT/GB2014/053646, dated Apr. 23, 2015.

U.K. Search Report for Application No. GB1321723.7 dated Jun. 10, 2014, 3 pages.

* cited by examiner

SECURITY DEVICES AND STRAPS THEREFOR

The present application is the U.S. national phase under § 371 of International Application No. PCT/GB2014/053646, having an international filing date of Dec. 9, 2014, which claims priority to UK Patent Application Nos. 1321722.9, filed Dec. 9, 2013; 1321723.7, filed Dec. 9, 2013; and, 1416799.3, filed Sep. 23, 2014. The entire contents of the above-mentioned prior-filed applications are hereby expressly incorporated herein by reference.

This invention relates to security devices and straps for such devices. Such straps and devices can be used to secure baggage and light vehicles in the manner described in various patent publications including International Specification No: WO 2010/103327, and U.S. Pat. Nos. 5,706,679 and 6,510,717. Such straps and devices are also described in Japanese Specification S3172632; German Specification DE9015213 U; Swiss Specification CH620493 A5; International Specification WO2010/116350; and British Specification 2 476 796A. Reference is directed to each of these documents as background material to the present invention.

The present invention is directed at a strap for security devices, and is concerned with the need to provide a strap that is sufficiently resistant to cutting to so hamper a cutting process as to render it impractical to complete the process. Many thefts are only attempted if they can be completed swiftly, and for this reason the invention is particularly directed at the speed at which the strap can be cut. To this end, a strap of the invention has a core within a flexible sleeve, and the sleeve is extensible independently of the core such that the core is not under tension. Because the core is not under tension, it is more difficult to cut and substantially inhibits, if not prevents, cutting of the sleeve and the strap as a whole. Even if the material of the sleeve can be cut, the core will substantially prevent it from being completely severed in a single action. The core may take various forms which resist cutting in different ways, and the sleeve can also be designed to complicate any attempt to cut the strap as a whole.

According to one aspect of the invention the strap has a central core comprising at least one elongate planar body with longitudinal flexibility but resistant to lateral flexure. In another aspect the strap has a central metallic core comprising one or more extensible springs. In both aspects the core is confined within a flexible sleeve.

Where the core is a planar body, in order to minimise weight, the body can have spaced openings formed therein, but for maximum strength it is continuous throughout. The planar body can be of any suitable material, usually metallic, but may be in the form of rubber or a plastics moulding. It might be ribbed, with the ribs extending laterally, or it could comprise interlinked lateral beams in a similar construction to that used in metal watch straps, and the beams can of course be metallic. In other alternatives, the core may comprise a metal, a rubber or a synthetic composite base element coated with a cut-resistant material such as silicon carbide, boron carbide, cobalt or a ceramic or a ceramic metallic composite. Such a coating will normally be continuous, but it could be discontinuous or patterned. For example, it may take the form of continuous or discontinuous strips which might be staggered across the base element, or applied only along marginal edge sections. One or more of a variety of particulate or continuous materials might be used.

The planar body must be longitudinally flexible such that it can bend around items for locking purposes, and have flexibility substantially limited to the two axes of the plane. Its planarity resists or substantially prevents flexure around an axis perpendicular to its plane. Spring steel is a material that meets these requirements well, and can be used alone, or as the base element in the embodiments referred to above. In a particular embodiment the core comprises a bimetal strip in which a central section is bounded by marginal edge sections of a harder steel than that of the central section.

The core may comprise multiple planar bodies of the kind discussed above, which may be movable relative to each other. If one or more of the bodies is a coated element, the coating can be on one side only, and normally facing outwardly rather than inwards.

The characteristics of the core described above are such that in practice any attempt to cut the body must engage its planar or transverse surfaces, or crush or buckle it from its edges. This is complicated by the presence of the sleeve which disrupts any cutting attempt. In preferred straps according to the invention the sleeve comprises braided yarns and these yarns can also be metallic. However, materials such as carbon fibre, synthetic fibres such as Kevlar; glass fibre; mineral fibre such as basalt, and other synthetic materials and elastomers can be used. Although normally woven, such yarns can also be knitted. The actual structure of the sleeve is though less critical, and some plastics extrusions can be sufficient. However, the selection of a material for the sleeve should take account of its function to resist stretching. In some embodiments it will provide the primary tensile strength of the strap.

Where the core comprises a spring, the spring is typically an helical spring. In a preferred variant, a flattened helical spring is used, which has a substantially elliptical cross-section. In either of these forms, the spring may contain a filler. In another alternative form, the spring is one which in its relaxed state, comprises an elongate planar element extending in a series of overlapping folds within the sleeve. Whatever form of spring is used, it can be itself enclosed within a flexible tube which is within and independent of the sleeve. The core may comprise a plurality of springs, possibly within their own tubes, and in the same or different forms, which can be twisted, woven or braided within the sleeve. Additional or supplementary yarns can also be included if desired, provided they do not interfere with the freedom of movement of the spring or springs within the sleeve. In preferred versions of this variant a flattened single spring will be used, or multiple springs will be arranged in a generally planar array to create an elongate cross section effectively requiring any attempt to cut the strap to engage its transverse or lateral surfaces or crush it from its edges, as described above with reference to embodiments with planar body cores. Similar sleeves can also be used.

In some straps of the invention the sleeve can itself be designed with the particular purpose of providing additional resistance to any attempt to cut the strap. With this intent, it can comprise an inner and an outer layer. The outer layer can be similar to the sleeves discussed above. Thus, in a particular embodiment the inner layer is of flexible material, and the outer layer comprises multiple yarns, which are normally woven, knitted or braided. The yarns of the outer layer are typically metallic, but synthetic materials such as carbon fibre, synthetic fibres such as Kevlar; glass fibre; and mineral fibre such as basalt, and other synthetic materials and elastomers such as aramids or composite plastics can be used. Preferred materials for the inner sleeve layer are soft cut-proof fabrics which may be woven, knitted or stitch bonded, but other bulk materials can also be used which comprise mixtures of materials which include elongate flexible components. The function of the inner layer is to complicate any attempt to cut the strap which has succeeded in breaking through the outer layer.

To be used in a security device, a strap according to the invention will normally have complementary locking units at either end, with each unit being secured to the sleeve and receiving an end of the core. The length of the core is preferably at least equal to the space between the locking units when the sleeve is fully extended, and the ends of the core preferably remain in the respective locking units when the sleeve is fully extended. However, it will be appreciated that when in use the strap will usually be wound or bent in some way which renders it difficult or impossible to stretch it to an extent that enables the core to be spaced from the strap ends. Nevertheless, in some embodiments, the core can be loosely attached to the locking units, and give the locking device additional tensile strength by virtue of its ends still being held in the respective locking units when the sleeve is fully or over extended. One way of accomplishing this while ensuring that the sleeve remains extensible independently of the core is by forming at least one elongate slot at each end of the core, which slot receives a pin fixed in the respective locking unit. The pin thereby allows lengthwise movement of the core relative to each locking unit corresponding to the length of the slot or slots. Another means of accomplishing this is to form a rib at each end of the core, which rib is located behind a shoulder in the respective locking unit to prevent total withdrawal of the core from the locking unit. Other mechanisms, including elastic mechanisms, can be used to accommodate controlled extension of the strap while retaining some attachment to the core. A function of such attachment is to prevent or inhibit excessive stretching of the sleeve when the strap is not in use. Where the core comprises a spring, the core can itself be extensible in some embodiments, and direct attachment to the locking units can therefore be acceptable in particular circumstances; for example, when extension of the sleeve is restricted.

While normally used in a device of the kind described above, straps of the invention can also be used as different forms of closure, permanent or temporary. For example, a strap can be used as a latch accessible from only one side of a closure, or its ends could be permanently attached to create a seal on a container. The closure component would of course be the sleeve, with the ends of the sleeve being attached, permanently or temporarily, to the elements being secured.

Embodiments of this invention will now be described by way of example and with reference to the accompanying drawings wherein.

Figure 1:
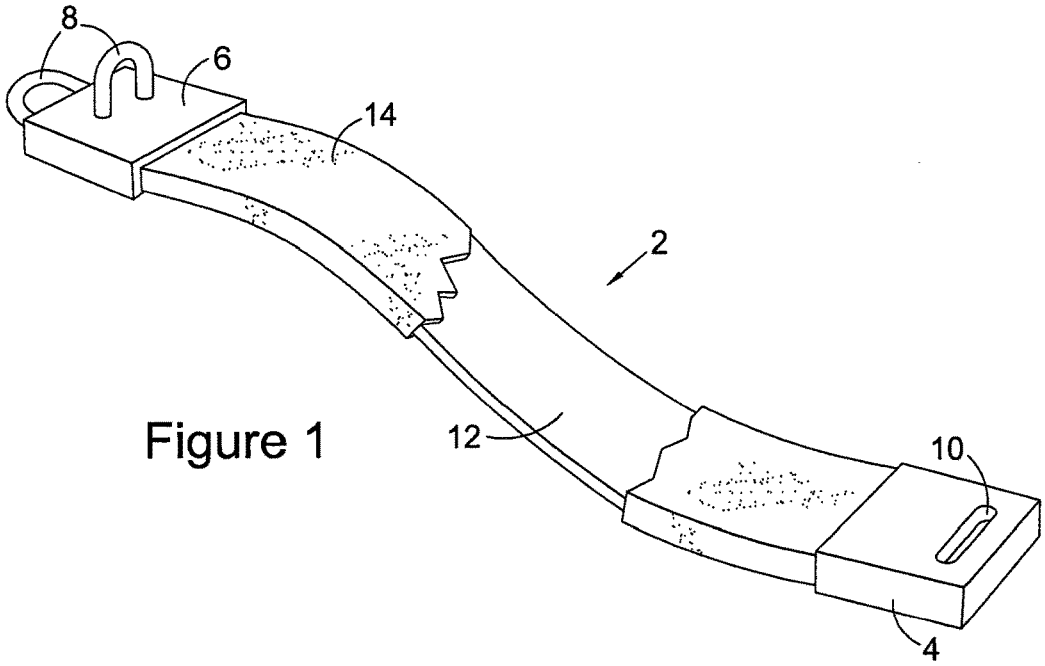
FIG. 1 is a partly broken perspective view of a security device with a strap according to a first embodiment of the invention.

The device shown in FIG. 1 consists of a strap 2 extending between two locking units 4,6. The unit 6 has two U-shaped elements 8 adapted to extend through a slot 10 in unit 4 when the device is used in the form of a loop. A padlock or other mechanism (not shown) may be used to prevent the element 8 from being withdrawn from the slot 10.

The strap 2 itself consists of a core 12 within a sleeve 14. Each end of the sleeve 14 is fixedly attached to a respective one of the locking units 4 and 6. The core 12 can move within the sleeve, but each end of the core 12 will also extend into a respective locking unit. The sleeve is itself extensible to some degree but not to an extent that the core withdraws at one or other end from a respective locking unit.

The core 12 of the strap in the device of FIG. 1 is a length of spring steel, typically up to 5 centimeters wide and less than 1 millimeter thick. Preferred widths are in the range 5-88 mms, with 38-42 mms being particularly preferred. The thickness will not normally be less than 0.2 mm with a typical thickness being 0.5 mm, but this dimension will depend upon not only the nature of the material, but also whether there is more than one planar element in the core. It can be readily bent to form a loop when the locking members mate but because of its free movement within the sleeve 14, this bending does not put it under direct tensile stress. A particularly preferred form is a bimetal strip with a central band of relatively low carbon; say 0.75%, steel, and marginal edges of relatively high carbon; say 0.95% steel. In a 5 cm strip the central band would have a width of around 4 cm, and the marginal bands a width of around 0.5 cm. When multiple planar bodies form the core, the space or spaces between them may be lined to facilitate their relative movement. Textile materials can be used for this purpose.

As noted above, the sleeve may be formed from a variety of materials but in one preferred embodiment it consists of braided metallic yarns which can be readily secured to metallic locking units. The sleeve thus provides primary tensile strength for the strap while the core offers maximum resistance to cutting using conventional quick acting tools. The nature of the sleeve will determine the overall dimensions of the strap cross-section, which will typically be 4-8 cms×1-2 cms.

Figure 2:
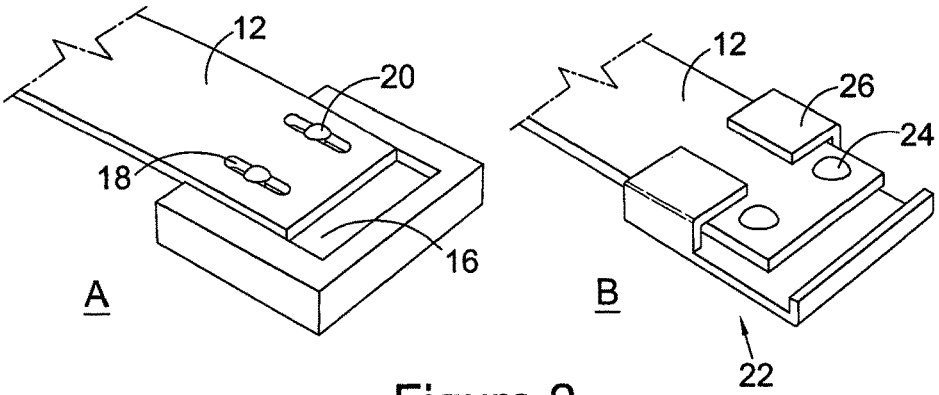
FIG. 2 illustrates alternative detail views of a locking element in the device of FIG. 1.

In order to ensure that the core 12 is not withdrawn from the locking units 4,6 when the sleeve 14 is extended, a mechanism such as are shown in FIG. 2 is employed. Each shows the interior of a locking unit with the core 12 extending thereinto. In FIG. 2A the core is received in a channel 16 within the locking unit. The end of the core 12 is formed with two elongate slots 18 which receive pins 20 secured in the base of the channel 16. This arrangement allows movement of the locking unit (4,6) relative to the core to an extent determined by the length of the slots. Critically though, the pin and slot arrangement prevents the core from withdrawing entirely from the channel 16 and thereby from the respective locking unit.

FIG. 2B shows an alternative restraining system. In this arrangement a bracket 22 within a respective locking unit forms an entry passage for the core 12, and spigots 24 formed at the end of the core 12 project beyond the cross-section of the passage. Thus, as the core 12 is withdrawn from the locking unit, the spigots engage shoulders 26 of the passage to prevent it.

Figure 3:
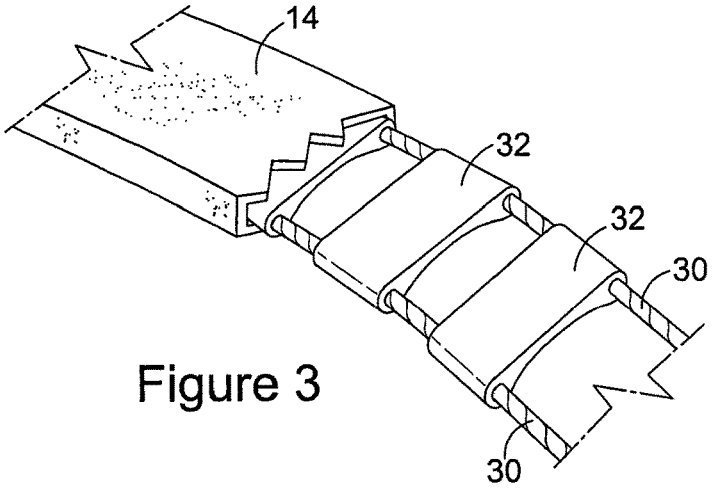
FIGS. 3, 4 and 5 illustrate alternative forms of core in a device of the kind shown in FIG. 1.
Figure 4:
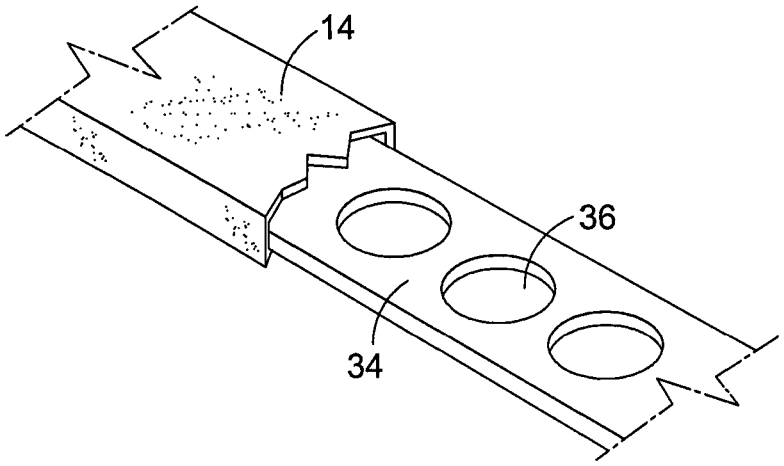
Figure 5:
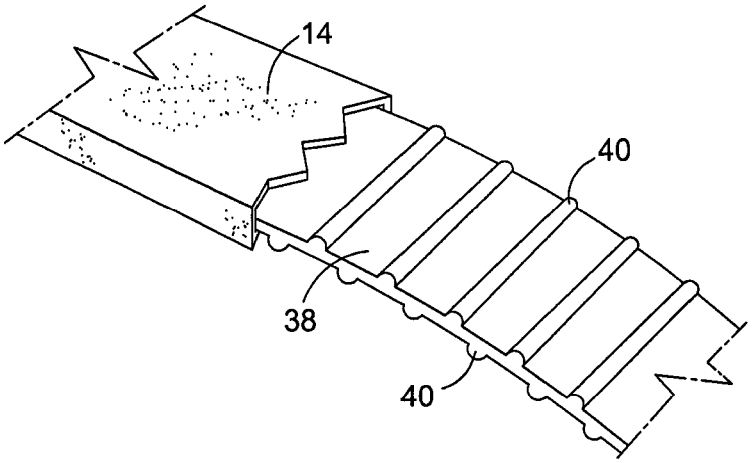

FIGS. 3, 4 and 5 illustrate alternative planar bodies that form the core in a strap according to the invention. That of FIG. 3 consists of aligned yarns 30 held apart by a series of spacers 32. Both the yarns and the spacers will normally be metallic, and although illustrated as being quite separate, the spacers will normally be located very close together, and could overlap.

In the strap construction shown in FIG. 3, the core 34 is illustrated as a planar body similar to that in FIG. 1, but with spaced perforations 36. This significantly reduces the weight of the core but does on the other hand, also make it more fragile. There is then, a compromise to be made between weight and strength, and cost depending on the material used.

FIG. 5 shows another form of core 38 as a moulded plastics material formed with lateral ribs 40. The ribs facilitate bending of the core around axes parallel thereto to the ribs, with minimal distortion in other directions. Core 38 is shown with ribs on both sides, but it is sometimes preferable to use them only on one side to facilitate free movement of the core relative to the sleeve.

Each of the cores described above can comprise multiple planar bodies, and when multiple bodies are used they do not of course have to be the same, although they normally will be. This is beneficial in the embodiments of FIGS. 3 and 4 as, particularly with that of FIG. 3, it can minimise the risk that weak sections such as the rope 30 form the only resistance apart from the sleeve to a cutting implement. Once again though, a compromise must be established between weight and strength as discussed above with reference to FIG. 4.

In any of the straps described with reference to FIGS. 1 to 5 the core surfaces may be coated with a cut-resistant material in particulate or continuous form, of the kinds referred to above.

Figure 6:
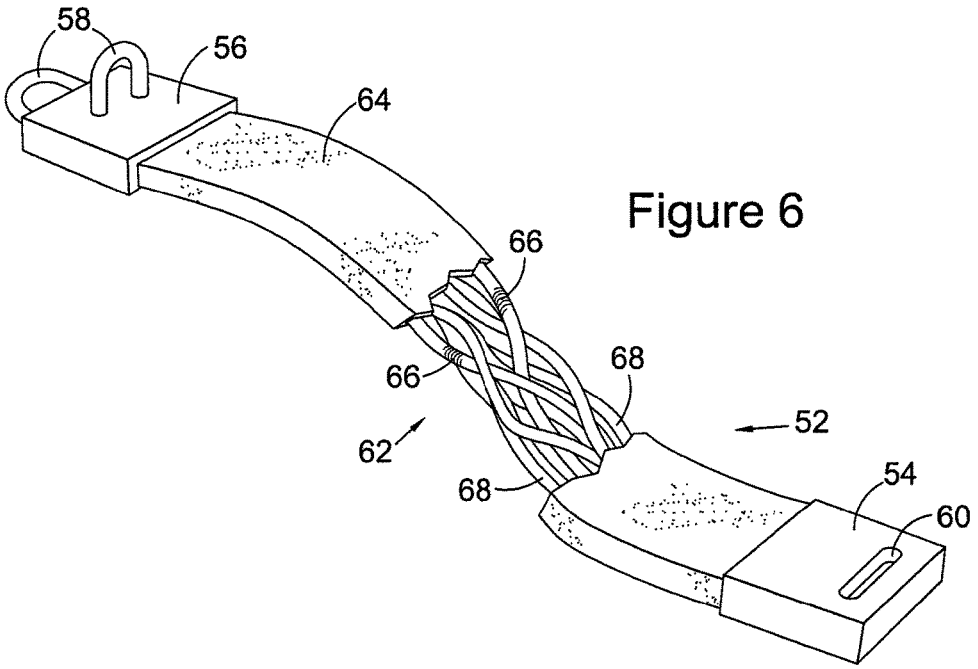
FIG. 6 is a part-broken perspective view showing a security device with a strap according to a second embodiment of the invention.

The device shown in FIG. 6 is similar to that of FIG. 1 in that it consists of a strap 52 extending between two locking units 54,56. The unit 56 has two U-shaped elements 58 adapted to extend through a slot 60 in unit 54 when the device is used in the form of a loop. A padlock or other mechanism (not shown) may be used to prevent the element 58 from being withdrawn from the slot 60.

The strap 52 itself consists of a core 62 within a sleeve 64. Each end of the sleeve 64 is fixedly attached to a respective one of the locking units 54 and 56. The core 62 can move within the sleeve, but each end of the core 62 will also extend into a respective locking unit. The sleeve is itself extensible to some degree but not to an extent that the core withdraws at one or other end from a respective locking unit. The strap is typically around 5 cms wide; its thickness will depend upon the nature of the core, but will normally be no more than 2 cms.

The core 62 in the embodiment of FIG. 6 comprises a plurality of extensible springs 66 which can be randomly intermingled, or deliberately twisted, woven or braided. In some embodiments they can be mixed with supplementary yarns 68 of other material or materials, provided they do not interfere with the freedom of movement of the core within the sleeve.

Figure 7:
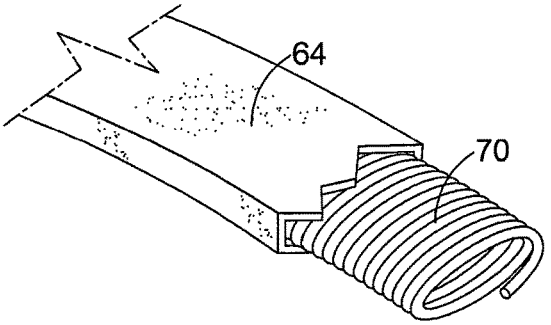
FIGS. 7 and 8 show alternative forms of cores for use in the strap of the device of FIG. 6.

FIG. 7 illustrates the cross-section of a strap according to the invention which could be used in place of that shown in the device of FIG. 6. Within the sleeve 64 the core comprises an helical spring 70. The turns in the spring 70 are closely spaced or touching, and because the core is independent of the sleeve, the turns do of course remain in this state as the sleeve is extended. The cross-section of the spring (and sleeve) can be circular, but it could be elliptical, giving the overall appearance of the strap a flatter shape. An elliptical cross-section also facilitates bending of the strap about an axis parallel to the longitudinal ellipse axes.

Figure 8:
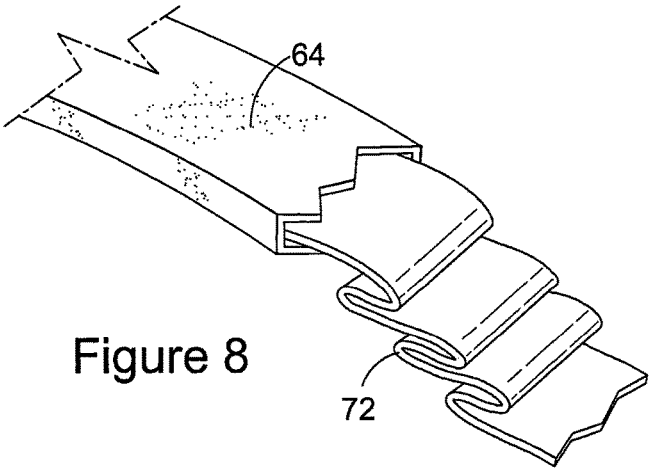

In the strap of FIG. 8 the core comprises an elongate planar body with folds 72 overlapping in longitudinal direction. This arrangement has the advantage that the core has a thickness of at least three layers at any point along its length, and any attempt to stretch it will be resisted by the sleeve 62 which inhibits the separation of the folds.

Figure 9:
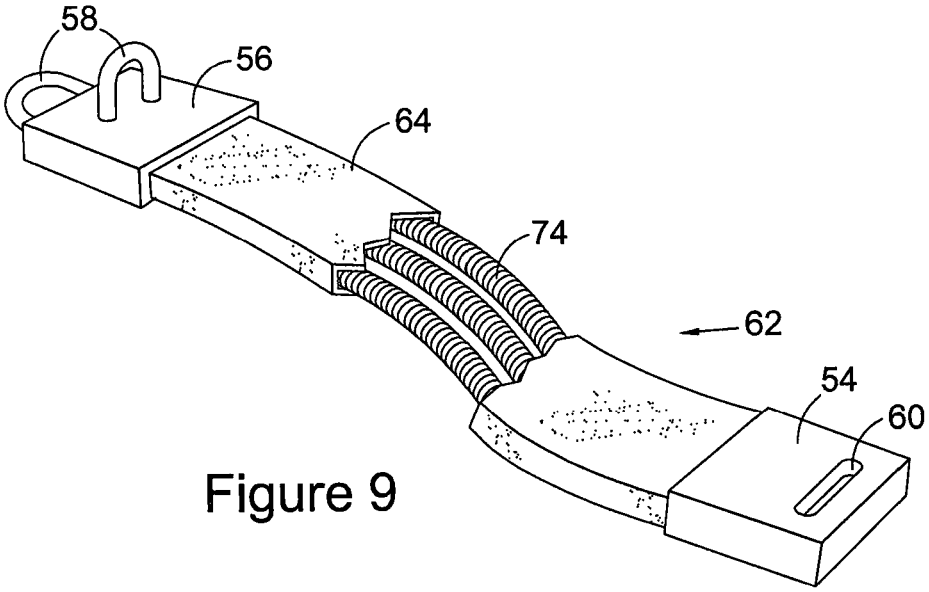
FIG. 9 is a partly broken perspective view of a security device with a strap according to a third embodiment of the invention.

In the device illustrated in FIG. 9 the core comprises a flat array of extensible springs 74; three are shown but two or more than three may be used. This arrangement, as in the arrangement of FIG. 7, facilitates bending of the strap around lateral axes, but additionally serves to resist flexure about an axis perpendicular to the plane of the array.

The sleeve 14 or 64 can also in some embodiments of the invention comprise multiple layers, which can be each of the same material, or mixtures of those referred to above. For example, a sleeve comprising a plastics extrusion on the outside with a layer of braided yarns directly surrounding the core can be very effective.

Figure 10:
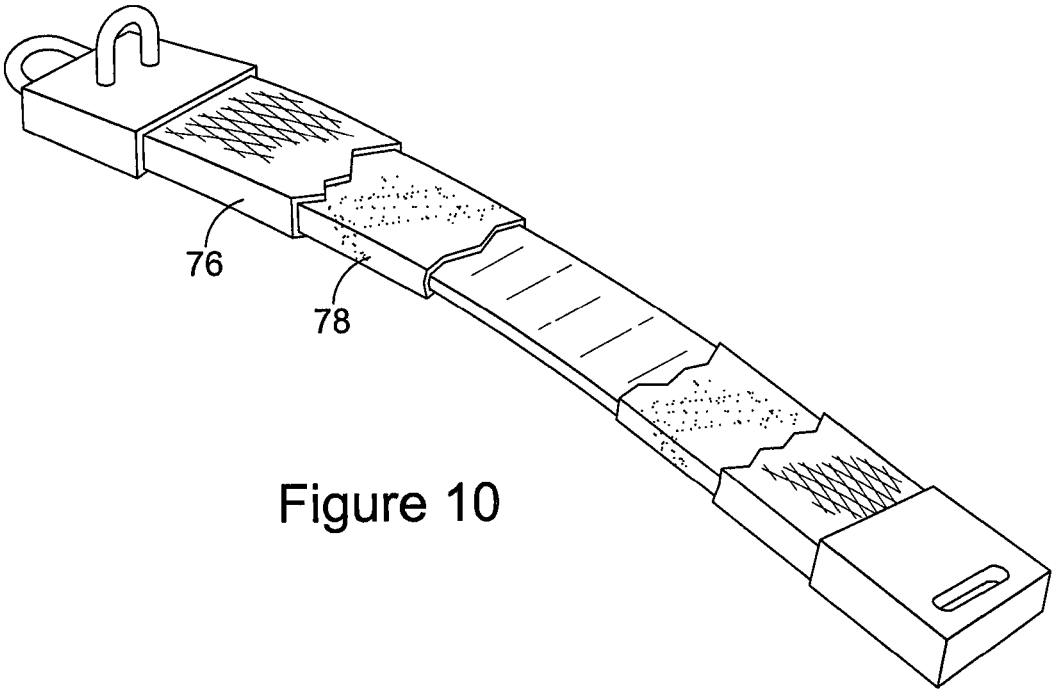
FIG. 10 is a partly broken perspective view of a security device with a strap according to a fourth embodiment of the invention.

FIG. 10 illustrates the use of another multilayer sleeve in a strap of the invention, and can be part of any of the embodiments described above. The sleeve outer layer 76 may be formed from a variety of materials but in one preferred embodiment it consists of braided metallic yarns which can be readily secured to metallic locking units. The sleeve outer layer 76 thus provides primary tensile strength for the strap while the core offers maximum resistance to cutting using conventional quick acting tools. The nature of the sleeve outer layer will determine the overall dimensions of the strap cross-section, which will typically be 6-8 cms×1-2 cms.

Also as noted above, the sleeve inner layer 78 may be formed from a variety of materials but in one preferred embodiment it consists of a bulk material having little tensile strength, but including multiple strands. These strands are themselves mobile within the material and wrap around a cutting tool that has at least partially broken through the outer layer 76. Knitted or stitch bonded materials can function in a similar manner.

As in security devices of the kind illustrated in FIGS. 1 to 5, in those of FIGS. 6 to 10 the core of the strap can be loosely attached at each end to the locking units 54 and 56 to ensure that the core ends remain within the locking units even when the sleeve is extended. Various mechanisms can be used for this, as discussed above.

A strap embodying the invention will typically be used in a form in which its two ends are coupled to locking units, generally as described above, for locking bicycles or securing bicycles or other items to stationary fixtures. However, the strap can be used without such units; for example as a seal closing an access opening. It could serve as a permanent closure, or a closure only releasable from one side. By selection of a suitable sleeve material, it can provide an indication of an attempt to cut or break it. In such use, each end of the sleeve is attached to one of the elements with the core movable within it. The attachment mechanism at each end will be selected for the particular purpose, and may be permanent or temporary. The core will normally always extend into the respective mechanisms, but the arrangement should be such that only the section of the sleeve containing the core is accessible. In this arrangement, both the sleeve and the core must be cut if the closure is to be broken.

The invention claimed is:

1. A security device in which a strap with a central core consisting of at least one elongate planar body is contained within a flexible sleeve, with complementary locking units secured at opposite ends of the flexible sleeve, wherein the complementary locking units receive respective ends of the central core, wherein the flexible sleeve is extensible independently of the central core such that the central core is not under tension, and wherein a length of the central core is at least equal to a spacing between the complementary locking units when the flexible sleeve is fully extended.

2. The security device of claim 1, wherein the flexible sleeve comprises one of woven, knitted, braided and stitch bonded yarns.

3. The security device of claim 1, wherein the flexible sleeve comprises metallic yarns.

4. The security device of claim 1, wherein the flexible sleeve comprises yarns formed in a synthetic material.

5. The security device of claim 4, wherein the synthetic material is elastomeric.

6. The security device of claim 1, wherein the flexible sleeve is a plastics extrusion.

7. The security device of claim 1, wherein the flexible sleeve comprises a plurality of layers.

8. The security device of claim 7, wherein the flexible sleeve has an outer layer comprising multiple yarns and an inner layer comprising a bulk material.

9. The security device of claim 1, wherein a maximum extended length of the flexible sleeve between the complementary locking units is less than the length of the central core and the respective ends of the central core remain in the complementary locking units when the flexible sleeve is fully extended.

10. The security device of claim 1, wherein at least one elongate slot is formed at each end of the central core, wherein the at least one elongate slot receives a pin fixed in a respective one of the complementary locking units, thereby allowing lengthwise movement of the central core relative to each of the complementary locking units corresponding to a length of the at least one elongate slot.

11. The security device of claim 1, wherein a lateral rib is formed at each end of the central core, the lateral rib located behind a shoulder in the respective one of the complementary locking units to prevent withdrawal of the central core therefrom.

12. The security device of claim 1, wherein an extensible coupling attaches each end of the central core to the respective one of the complementary locking units.

13. The security device of claim 12, wherein the extensible coupling is elastic.

14. A security device in which a strap with a central core comprising at least one elongate planar body with longitudinal flexibility but resistance to lateral flexure is contained within a flexible sleeve, with complementary locking units secured at opposite ends of the flexible sleeve, wherein the complementary locking units receive respective ends of the central core, wherein the flexible sleeve is extensible independently of the central core such that the central core is not under tension, and wherein a length of the central core is at least equal to a spacing between the complementary locking units when the flexible sleeve is fully extended.

15. The security device of claim 14, wherein the at least one elongate planar body has spaced openings formed therein.

16. The security device of claim 14, wherein the at least one elongate planar body is metallic.

17. The security device of claim 14, wherein the at least one elongate planar body is in a form of a ribbed plastics moulding.

18. The security device of claim 14, wherein the at least one elongate planar body comprises interlinked lateral beams.

19. The security device of claim 18, wherein the interlinked lateral beams are metallic.

20. The security device of claim 14, wherein the at least one elongate planar body is coated with a cut-resistant material.

21. The security device of claim 14, wherein the central core comprises a plurality of said at least one elongate planar body.

22. The security device of claim 14, wherein the flexible sleeve has an outer layer comprising multiple yarns and an inner layer comprising a bulk material.

23. The security device of claim 14, wherein an extensible coupling attaches each end of the central core to the respective one of the complementary locking units.

24. The security device of claim 14, wherein a maximum extended length of the flexible sleeve between the complementary locking units is less than the length of the central core and the respective ends of the central core remain in the complementary locking units when the flexible sleeve is fully extended.

25. The security device of claim 14, wherein the at least one elongate planar body comprises a series of folds overlapping in a longitudinal direction of the at least one elongate planar body.

26. A security device in which a strap with a central core comprising at least one extensible helical spring is contained within a flexible sleeve, with complementary locking units secured at opposite ends of the flexible sleeve, wherein the complementary locking units receive respective ends of the central core, wherein the flexible sleeve is extensible independently of the central core such that the central core is not under tension, and wherein a length of the central core is at least equal to a spacing between the complementary locking units when the flexible sleeve is fully extended.

27. The security device of claim 26, wherein the at least one extensible helical spring is a flattened helical spring having a substantially elliptical cross-section.

28. The security device of claim 26, wherein a space within the at least one extensible helical spring contains a filler.

29. The security device of claim 26, wherein the at least one extensible helical spring is enclosed within a flexible tube independent of the flexible sleeve.

30. The security device of claim 26, wherein the central core comprises a plurality of said at least one extensible helical spring.

31. The security device of claim 30, wherein the plurality of said at least one extensible helical spring is braided within the flexible sleeve.

32. The security device of claim 26, wherein the flexible sleeve has an outer layer comprising multiple yarns and an inner layer comprising a bulk material.

33. The security device of claim 26, wherein an extensible coupling attaches each end of the central core to the respective one of the complementary locking units.

34. The security device of claim 26, wherein a maximum extended length of the flexible sleeve between the complementary locking units is less than the length of the central core and the respective ends of the central core remain in the complementary locking units when the flexible sleeve is fully extended.

* * * * *